United States Patent [19]

Kittinger et al.

[11] Patent Number: 4,728,163

[45] Date of Patent: Mar. 1, 1988

[54] DUAL GENDER ELECTRICAL PLUG

[76] Inventors: Bruce E. Kittinger, 400 S. Howes St., Ste 3, Fort Collins, Colo. 80521; Patrick J. Burns, 1718 Burnwood Dr., Fort Collins, Colo. 80525; James M. Kincaid, III, 3124 Placer St., Fort Collins, Colo. 80526

[21] Appl. No.: 727,113

[22] Filed: Apr. 25, 1985

[51] Int. Cl.[4] ..... H01R 29/00

[52] U.S. Cl. ..... 439/172; 439/176

[58] Field of Search ..... 339/31 R, 31 M, 32 R, 339/48, 49 R, 59 M, 176 M, 176 S, 211, 265 R

[56] References Cited

U.S. PATENT DOCUMENTS 3,017,603 1/1982 Bac ..... 339/31 M 3,173,736 3/1965 Brinkel et al. ..... 339/31 R

*Primary Examiner*—Gil Weidenfeld

*Assistant Examiner*—Paula A. Austin

*Attorney, Agent, or Firm*—Joseph C. Herring

[57] ABSTRACT

A dual gender electrical connector is made up of a "male" member, a "female" member, and a positioning means. The positioning means may be integral with either the male or female member, and/or a part of any shielding used. The male member is made up of a non-conductive support material of predetermined thickness in which electrically conductive electrical contacts are embedded in parallel. Short lengths of the electrical contacts are exposed on the rear end for connection to electrical conductors. Longer lengths of electrical contacts are exposed on the front end. The female member is made up of an electrically non-conductive support material of the basic form and often the same material as the male member, though not the same depth as the male member. Tubes having a length equal to approximately the depth of the female member support material are positioned within the support material so as to be capable of sliding over and in contact with the electrical contacts of the male member. When the female member is drawn forward by the positioning means, electrical contacts of the male member penetrate only a small portion of the tubes of the female member and provide a female plug. When the female member is positioned adjacent to the male member, the male electrical contacts extend through and beyond the tubes of the female member to create a male plug.

11 Claims, 14 Drawing Figures

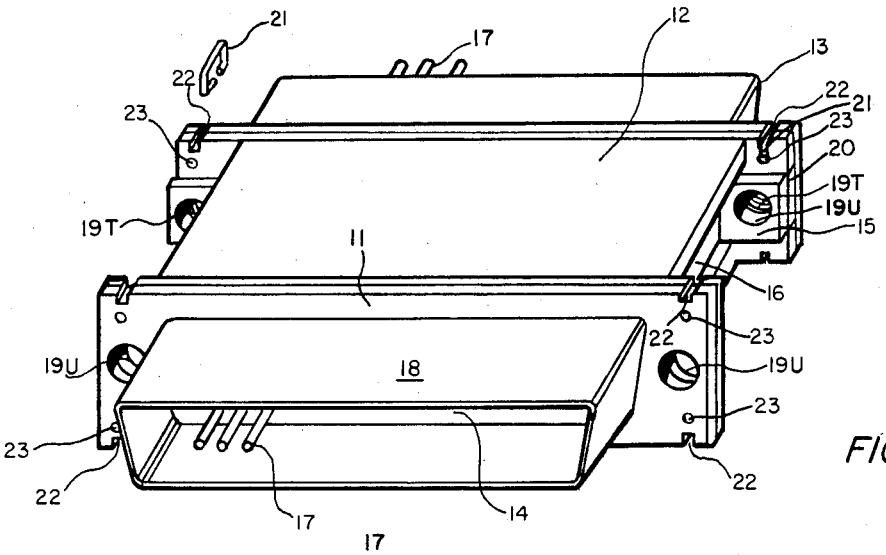
FIG. 1
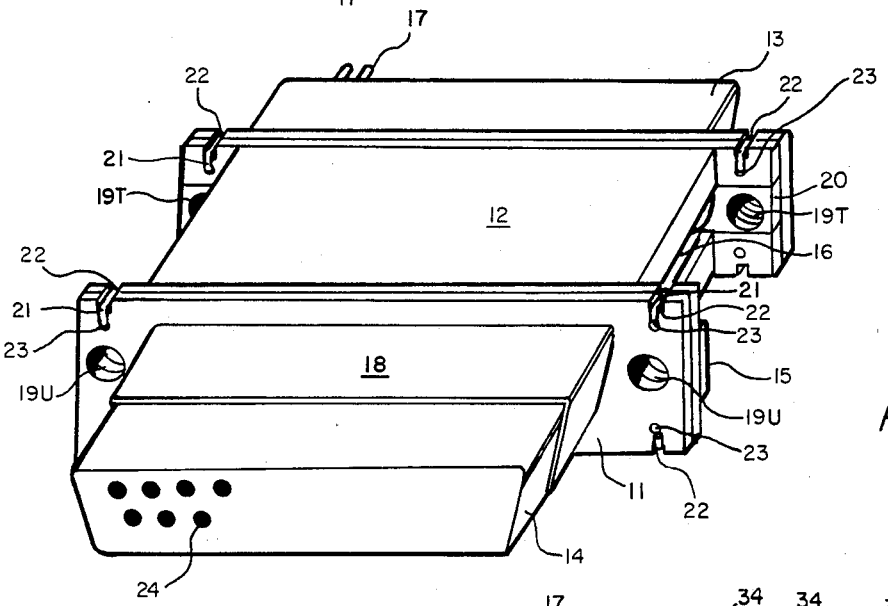
FIG. 2
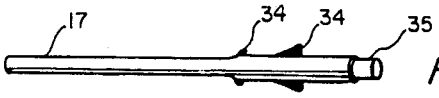
FIG. 8
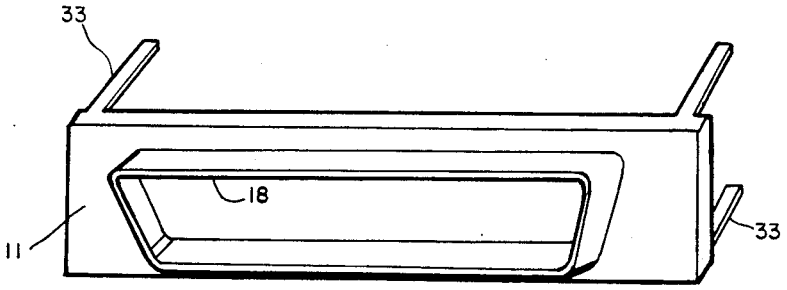
FIG. 7
FIG. 9
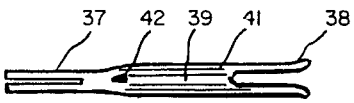
FIG. 10
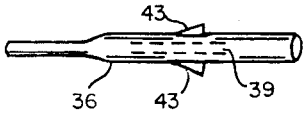

DUAL GENDER ELECTRICAL PLUG

BACKGROUND OF THE INVENTION

A variety of electrical plugs have been designed to act as either a male or female plug. The trend has been to move from designs where the user could change gender to designs where the manufacturer established the gender and it could not, thereafter, be changed. Typical references which show this trend are:

U.S. Pat. No. 1,516,581 issued to Seufert. The plug has two female receptacles in its front end which are threaded for a small distance at the bottom of the female electrical contacts. The male electrical contacts, which are normally stored in recepticles in the rear of the plug, are screwed into the female receptacles when it is desired to convert the plug to the male state.

U.S. Pat. No. 2,538,296 issued to Crocker. A household electrical plug is taught which has retractable male contacts. The plug is made up of a hollow shell which is flat on two sides, has a hole for the usual household electrical cord at its rear, and two holes for the usual flat male contacts at its front end. The electrical cord conductors connect to two metal spring contacts which extend along the inner sides and length of the plug. The contacts are curved inward at their forward ends. The male contacts are attached to a positioning "slide" at their rear end. The curved edges of the springs fit a concavity to lock the male contacts in the forward position. When the male contacts are retracted, i.e., in the female position, the springs along the side act as the female contacts when a male plug is inserted.

U.S. Pat. No. 2,796,591 issued to Carter et al. In this household plug, two conductors in a cord pass through a piston-shaped element positioned within a round plug. The conductors are attached to two flat male electrical contacts which are imbedded in the front of the piston. The piston is locked in a forward or rear position to achieve the desired gender.

The above patents teach the art wherein the user can adapt a plug as needed. This art required complex manufacturing processes, close tolerance fittings and large part inventories. The following art shows the trend to reduce the number of parts and the number of steps required to form and assemble the parts and plugs.

U.S. Pat. No. 3,083,344 issued to Long. An all-purpose plug is taught which can be used in its male form, in a female form, and as a connector between two cord ends. When used as a plug, a home electrical cord is attached to metal springs which have been performed to fit around positioning elements in the plug. At the other end, the conductive springs are connected with rotating fittings to the flat male electrical contacts.

During the manufacturing process, the springs and flat electrical contacts are positioned within one half of the plug so that the contacts are rotated to the rear when female plugs are required and to the front when male plugs are required. One half of the plug is then fused onto the other half.

U.S. Pat. No. 3,439,311 issued to Evans. This plug uses electrical contacts which are snaped to form a female receptacle on one end and a male contact on the other. The position in which the electrical contact is mounted within the plug determines the male or female character of the plug.

U.S. Pat. No. 4,010,993 issued to Hohenberger. A socket is formed by molding, and either a male or female element is inserted into place in the socket to complete the plug.

Still other patents change the character of the plug by inserting modules which lock into place and are then soldered or otherwise connected to electrical conductors through the end of the plug. Representative of this approach are U.S. Pat. No. 3,885,849 issued to Bailey, et al and U.S. Pat. No. 4,158,473 issued to Shearer.

As the plug art evolved, simplified mechanisms for attaching the electrical contacts of the plugs to wire conductors also evolved. A. C. Long, U.S. Pat. No. 3,083,344, A. C. Brown, U.S. Pat. No. 3,252,126, and R. M. Hohnenberger, U.S. Pat. No. 4,010,993 teach three approaches to soldered and quick-connect systems. Additional patents show that the industry has not only simplified its forming, assembly, and inventory, it has also tried to simplify the connection costs to reduce the ultimate assembly required from the user.

The present invention uses the improvements of the prior art to provide the low inventory costs and assembly costs required by the manufacturer and preserves the user's ability to convert gender. As such, it runs counter to the trends of the industry and provides a solution to many of industry's and user's problems. The inventions' various forms can be used in either the audio communication field, or the computer field. It can be metal sheathed for communication and computer usage purposes, and, as such, can have the usual male/female plug interlocks found in many military and communication industry plugs. Further, it can be adapted to be very lightweight for environments where shielding, dust resistance, water resistance, etc. are not required. Finally, it can use a variety of electrical contact cross-sections, i.e., those found in the various references described above.

SUMMARY OF THE INVENTION

This invention is a dual gender electrical connector made up of a "male" member, a "female" member, and a positioning means. The positioning means may be integral with either the male or female member, and/or a part of any shielding used. The male member is made up of a non-conductive support material of predetermined thickness in which electrically conductive electrical contacts are embedded in parallel. Short lengths of the electrical contacts are exposed on the rear end for connection to electrical conductors. Longer lengths of electrical contacts are exposed on the front end. The female member is made up of an electrically non-conductive support material of the basic form and often the same material as the male member, though not the same depth as the male member. Tubes having a length equal to approximately the depth of the female member support material are positioned within the support material so as to be capable of sliding over and in contact with the electrical contacts of the male member. When the female member is drawn forward by the positioning means, electrical contacts of the male member penetrate only a small portion of the tubes of the female member and provide a female plug. When the female member is positioned adjacent to the male member, the male electrical contacts extend through and beyond the tubes of the female member to create a male plug.

BRIEF DESCRIPTION OF THE DRAWINGS

FIGS. 1 through 11 are all shielded embodiments of the invention for use where shielding is required. FIGS. 5 and 6, and 13 are combined to form a lightweight, non-shielded embodiment of the invention for use where electronic interference, dust and other debris are not a problem.

FIGS. 1 and 2 depict a front view of the fully shielded embodiment in, first, the male gender mode and secondly, in the female gender mode.

FIGS. 3 and 4 depict the center housing of the embodiment of FIGS. 1 and 2 from the front and rear view.

FIGS. 5 and 6 depict the supports for the male and female contacts, respectively, without the electrical contacts in place.

FIG. 7 depicts a different form of the front and/or rear housing than that used in FIGS. 1 and 2.

FIG. 8 depicts a round male electrical contact in the "pin" form used in computer communications.

FIGS. 9 and 10 depict the corresponding female electrical contact in a top and side view, respectively.

FIG. 11 depicts a partially cut-away, three-dimensional view of a simplified model to show the interaction of the male and female electrical conductors with the plug in the male format.

FIG. 12 depicts a simplified three-dimensional embodiment wherein the shielding is an integral part of the non-conductive support body with the electrical conductors in the female form.

FIG. 13 depicts the use of a bolt and two or three nuts from the embodiment of FIGS. 1 through 11 as a simple positioning mechanism in an embodiment utilizing only the male and female support elements of FIGS. 5 and 6 to form a lightweight, non-shielded embodiment.

SPECIFIC DESCRIPTION OF THE DRAWINGS

Figure 3:
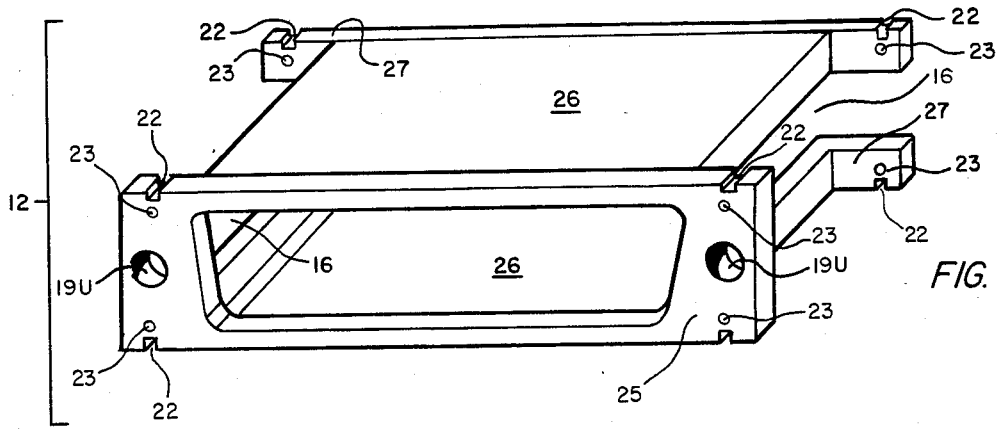

The embodiments of FIGS. 1–10 are "delta" configurations, an embodiment which is normally used in the computer industry. The embodiment of FIG. 1 has a front housing 11, a center housing 12, and a rear housing 13. The three housings are made of metal, and front housing 11 and rear housing 13 can be the same structural component. The face of female member 14 is shown through front housing 11. Female member 14 has, at its rear, a tab bar 15 which slides within the slots 16 formed by the sides of center housing 12. Three of an arbitrary number of conductive pins 17 project through the face of female member 14 and are protected from bending by the shield portion 18 of front housing 11. Pins 17 are shown projecting beyond the rear edge of rear housing 13 for expository reasons although they would not normally do so. Nuts and bolts (See FIG. 13) are used to position the male and female members. Unthreaded bolt holes 19U are shown in front housing 11, center housing 12, and tab bars 15. A "C" spring keeper 21 is shown at top left of FIG. 1. Keepers 21 are fitted into grooves 22 and holes 23 to lock the various housings together.

FIG. 2 depicts female member 14 in its forward position with seven of an arbitrary number of openings 24 for the electrically conductive sleeves forming the female electrical contacts. Keeper 21 is shown in place within grooves 22 and holes 23. Tab bar 20 is shown more clearly in this embodiment and is attached to rear housing 13 by countersunk screws (not shown).

Figure 4:
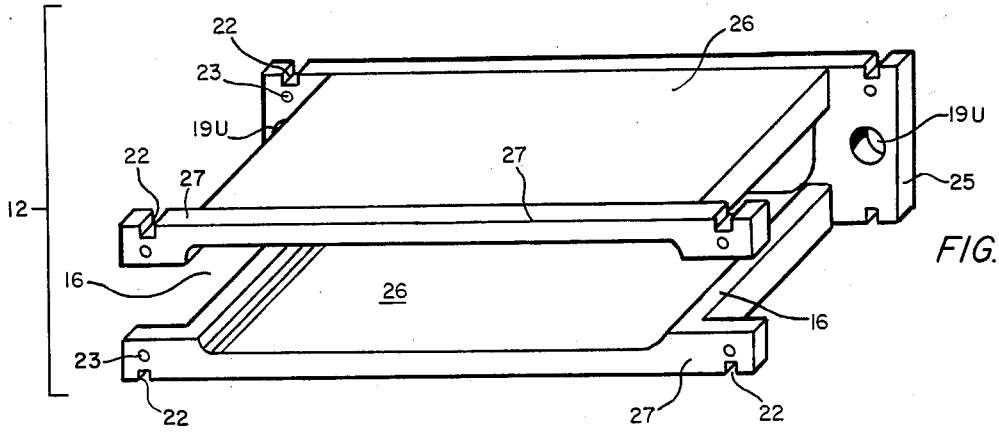

FIGS. 3 and 4 detail center housing 12 which is made up of a base 25, side plates 26 which form slots 16 with extended tabs 27 for attachment purposes. The shape of center housing 12 provides front and rear openings for female support member 14.

Figure 5:
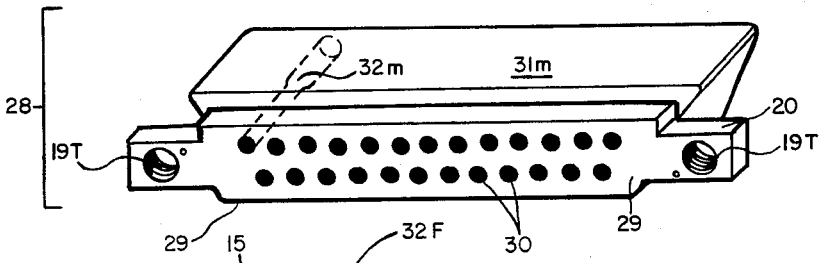

FIG. 5 provides a perspective view of the front of the body of male member 28 with its base 29, a typical complement of holes 30 for the insertion of pins 17 into support body 31M, and its one of an arbitrary number of sleeves 32M (shown in dashed lines) penetrating the entire depth of male member 28.

Figure 6:
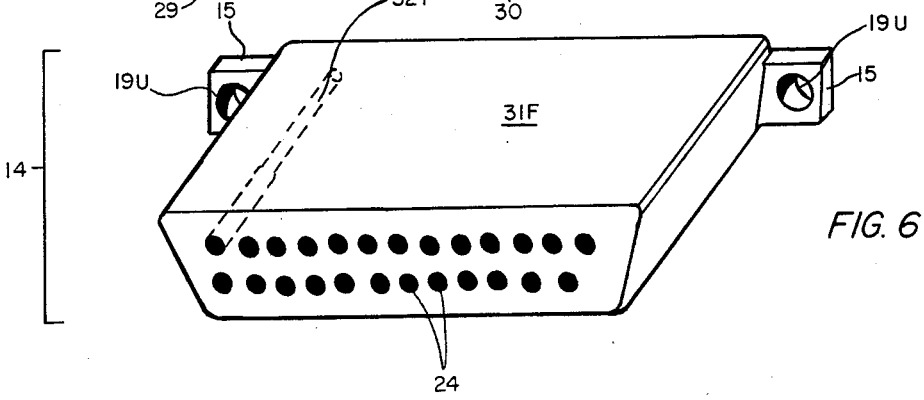

FIG. 6 is a perspective view of the front of female member 14 with its tab bar 15, its full complement of openings 24 for female tubular electrical (FIGS. 9 and 10) contacts which fit into the depicted one of an arbitrary number of sleeves 32F (shown in dashed lines) in support body 31F. Tab 20 holes are depicted as threaded when a bolt is to be an integral part of the male member 31M, but tab 15 holes are threaded when a bolt is to be an integral part of female member 31F.

FIG. 7 details a different form of front housing 11 and/or rear housing 13 wherein projections 33 are substituted for keeper 21, groove 22, and hole 23. Projection 33 is bent over and wrapped around center housing and rear housing elements to form an assembled connector.

FIG. 8 details one form of male electrical contact as a computer connector pin 17. Pin 17 has barbs and fins 34 to prevent pin 17 from sliding within sleeves 32M. The rear portion of pin 17 is shown as soldering post 35.

FIGS. 9 and 10 depict the side and top, respectively, of female electrical contact 36 having a slightly greater diameter than pin 17. The front portion 37 and rear portion 38 of female electrical contact 36 are split (side view) to facilitate assembly and the sliding contact movement of male member 17. To increase electrical contact, the center portion 39 is depressed and may even be cut during the manufacturing to form open slots 41. The female electrical contact can also have barbs 42 and fins 43 to position and anchor it within sleeves 32F.

Figure 11:
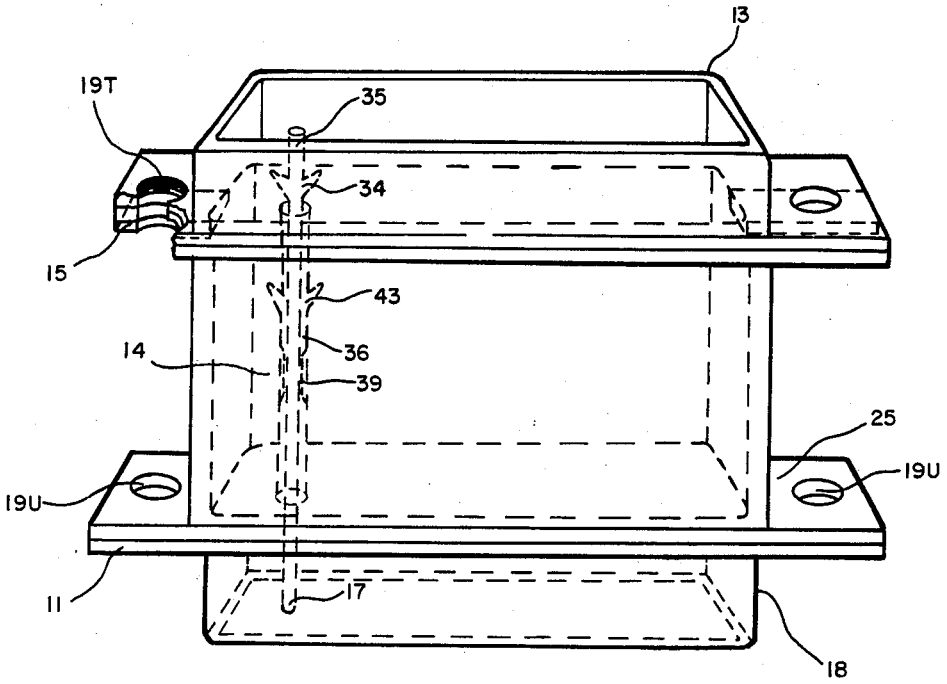

FIG. 11 details a simplified embodiment of the invention wherein many of the parts have been eliminated or abbreviated to show the interplay of one of the pins 17 and a female electrical contact 36 with the combination in the male mode. Pins 17 and female contact members 36 have been simplified by omitting front barbs 34 and 42 and by repositioning fins 34 and 43.

Figure 12:
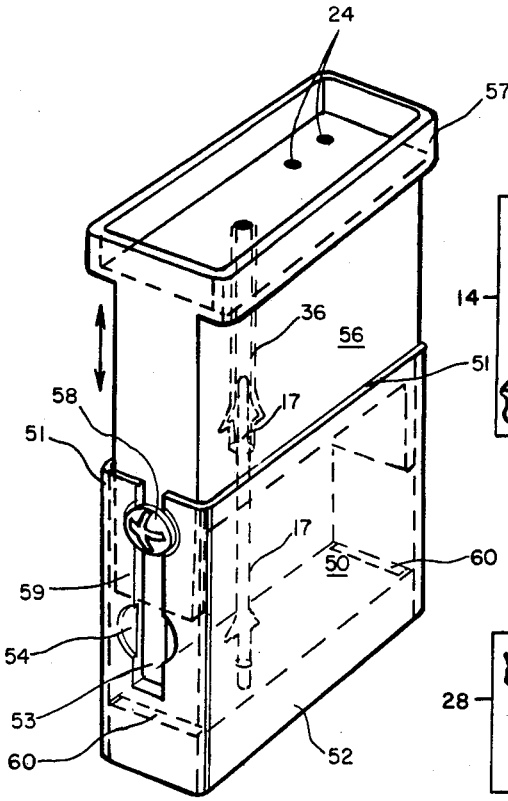
FIG. 12 depicts another embodiment. The same numbers are used for the same parts in the Figures except where the specification indicates otherwise.

FIG. 12 depicts a simplified view of an embodiment having a base 50 made up of shell 51 having a hollow shield 52 at its rear, and slots 53 with depressions 54 at each end. Depressions 53 are used to ensure that the correct position of the male member relative to the female member when set screw 58 is screwed into the bottom portion of female member 56 and the head of screw 58 is positioned in one of depressions 54. Female member 56 has a forward shield 57 and holes 24 for female electrical contacts 36. At the bottom end of female member 56 are blades 59 which, when the plug is in the male gender mode, slip through slots 60 in base 50. Blades 59 serve to align the members when the connector is positioned in the female mode.

Figure 13:
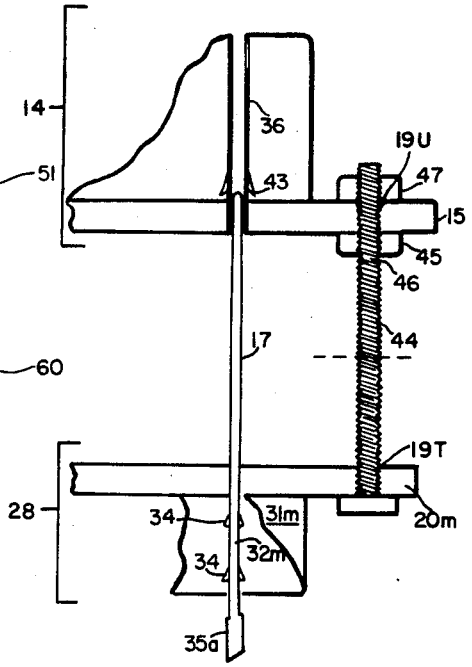

FIG. 13 is a cut-away of one end of a totally unshielded connector made up of the male member 28 of FIG. 5 and female member 14 of FIG. 6, modified to show a male pin 17 and female electrical contact 36 positioned at one end of the connector. Female member 14 and male member 28 are split along the midline to show, in detail, the elements of the positioning mechanism. Pin 17 has been modified to include a soldering sleeve 35*a* of the type used in U.S. Pat. No. 1,010,993. Threaded bolt 44 is screwed through threaded hole 19T. If a male gender connector is desired, bolt 44 is quite short, being no longer than the length indicated by the dashed line. If a female gender connector is desired, nut 45 is screwed onto a longer bolt 44 (shown) until it is positioned against mark 46 cut into bolt 44. At this point in both the male and female gender, the female electrical contacts 36 are seated on pins 17 and male member 28 is pushed toward female member 14 and nut 47 is tightened against tab bar 15 to complete assembly.

Figure 14:
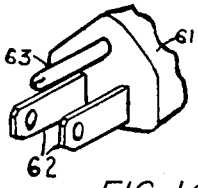
FIG. 14 depicts the electrical contacts of an electrical outlet.

FIG. 14 depicts the electrical contacts of the 110 v. AC electrical plug only to indicate other electrical contact configurations. The plug 61 is cut-away. Flat contacts 62 are typical for 110 v. AC plugs and round contact 63 is used to ground the system.

GENERAL DISCUSSION OF THE EMBODIMENTS OF THE INVENTION

The depth of the male member and the female member will depend upon the use of the plug. If the plug is to be used with household 110 volt-15 amp current, the male member should have a thickness of about 0.16 cm to about 0.24 cm and the female member a thickness of about 0.18 cm to about 0.26 cm. If the connector is to be used as a computer connector, the thickness of the male support member should be from about 0.1 cm to about 0.12 cm and the female from about 0.12 cm to about 0.14 cm. The lateral spacing between the male member and the female member will, of course, vary with the depth of these members and the particular use intended.

Metal shields used with the connectors of this invention are any of those currently used in the communications and audio arts. Normally, the shields will be tin, zinc, etc., coated iron or steel. Sometimes the shielding will be aluminum. Where the use of non-metallic shielding is permissible, the shielding can be of the same polymeric material as the support bodies. Suitable materials include hard rubber, polystyrene, polycarbonate, Teflon polymer and other non-electrically conductive, high impact resistant plastics.

The male and female electrical contacts can be made of the usual copper, brass, etc., spring metals normally used for such purposes.

Equivalents obvious to those skilled in the art are intended to be included within the scope of the invention. Such embodiments will be immediately obvious to those skilled in the art. For example, the substitution of flat or triangular electrical contacts for the round pins shown; the use of quick connect terminals instead of soldering posts 35; the use of flat clips instead of wire clips 21; the use of cam lock or other positioners to position the male and female members rather than the screws or bolts shown; the use of unthreaded holes 19 at all points and an extra bolt adjacent tab 20M and reversing the threading of tabs 15 and 20.

Now having described our invention, what we claim is:

1. An electrical plug adaptable by the user for use as either a male or female plug comprising:

a male member having electrically conductive male contacts embedded in parallel in electrically non-conductive support means of predetermined thickness, said male contacts being adapted, on one end, for connection to electrical wire conductors and extending, on the other end, a distance sufficient to extend through a female member and beyond a predetermined distance;

a female member having electrically conductive parallel sleeve means embedded in non-conductive support means of predetermined thickness and in predetermined positions within the non-conductive support means to permit the male contacts and the male support means to penetrate, and electrically contact the sleeve means in the female support means;

and positioning means adapted to position the male and female members adjacently to provide a male plug means and at a predetermined distance apart suitable for the combination of male support means and female support means to be utilized as a female plug.

2. The plug of claim 1 including a metal shielding means.

3. The plug of claim 1 including a non-metal shielding means.

4. The plug of claim 1 having the positioning means as an integral part of the male support means.

5. The plug of claim 1 having the positioning means as an integral part of the female support means.

6. The plug of claim 1 having a positioning means integrally attached to neither the male member nor the female member.

7. The plug of claim 1 adapted for use as a computer connector.

8. The plug of claim 1 adapted for use as a communications connector.

9. The plug of claim 1 adapted for use as an audio connector.

10. The plug of claim 1 adapted for use as an electrical connector.

11. All inventions described herein.

* * * * *